US010329726B2

(12) United States Patent
Chen et al.

(10) Patent No.: US 10,329,726 B2
(45) Date of Patent: Jun. 25, 2019

(54) METHOD OF DESIGNING BOX-TYPE ENERGY-DISSIPATING SECTION OF BOX-TYPE ENERGY-DISSIPATING MUDFLOW DIVERSION FLUME, AND APPLICATION

(71) Applicant: INSTITUTE OF MOUNTAIN HAZARDS AND ENVIRONMENT CHINESE ACADEMY OF SCIENCES, Sichuan (CN)

(72) Inventors: Jiangang Chen, Sichuan (CN); Xiaoqing Chen, Sichuan (CN); Yong You, Sichuan (CN); Wanyu Zhao, Sichuan (CN); Tao Wang, Sichuan (CN); Yuhua Zou, Sichuan (CN); Wei Zhong, Sichuan (CN); Fenghuan Su, Sichuan (CN); Shuai Li, Sichuan (CN)

(73) Assignee: INSTITUTE OF MOUNTAIN HAZARDS AND ENVIRONMENT CHINESE ACADEMY OF SCIENCES, Sichuan (CN)

( * ) Notice: Subject to any disclaimer, the term of this patent is extended or adjusted under 35 U.S.C. 154(b) by 0 days.

(21) Appl. No.: 15/757,855

(22) PCT Filed: Sep. 15, 2015

(86) PCT No.: PCT/CN2015/089589
§ 371 (c)(1),
(2) Date: Mar. 6, 2018

(87) PCT Pub. No.: WO2017/041315
PCT Pub. Date: Mar. 16, 2017

(65) Prior Publication Data

US 2018/0327990 A1 Nov. 15, 2018

(30) Foreign Application Priority Data

Sep. 9, 2015 (CN) ..... 2015 1 05682815

(51) Int. Cl.
*E02B 5/08* (2006.01)
*E02B 8/06* (2006.01)
*E02B 5/00* (2006.01)

(52) U.S. Cl.
CPC ..... *E02B 8/06* (2013.01); *E02B 5/00* (2013.01); *E02B 5/08* (2013.01)

(58) Field of Classification Search
CPC ..... E02B 8/06; E02B 5/08
See application file for complete search history.

(56) References Cited

U.S. PATENT DOCUMENTS 5,433,845 A * 7/1995 Greene ..... B01D 17/0208 137/561 A
5,757,665 A * 5/1998 Nestler ..... G06Q 10/04 405/36

(Continued)

FOREIGN PATENT DOCUMENTS

CN 103453944 A 12/2013
CN 104794362 A 7/2015

(Continued)

OTHER PUBLICATIONS

International Search Report issued in International Application No. PCT/CN2015/089589 dated Jun. 14, 2016.

*Primary Examiner* — Benjamin F Fiorello
(74) *Attorney, Agent, or Firm* — Scully Scott Murphy & Presser

(57) ABSTRACT

A method of designing a box-type energy-dissipating section of a box-type energy-dissipating mudflow diversion flume. Firstly, the longitudinal gradient J of the flume and the roughness coefficient n 0 of a fully-lined flume bottom (1) are determined. Then, the parameters of the box-type energy-dissipating section are set, and related parameters are substituted into a formula for calculation, so that the overall roughness coefficient n of the flume is obtained. Further, the flow velocity of the mudflow is calculated by means of the (Continued)

Manning formula. Finally, the flow velocity of the mudflow is compared with the non-scouring and non-silting velocity allowed by the flume, and the design value of the box-type energy-dissipating section is obtained through final optimization. The method factors in the longitudinal gradient J of the flume, the length L of the box-type energy-dissipating section, the width b of the box-type energy-dissipating section, and the average diameter D of filler stones. With the method, the overall roughness coefficient n of the flume under different design conditions can be determined reasonably, so as to further implement the optimized design of the box-type energy-dissipating section of the box-type energy-dissipating mudflow flume. Further provided is an application of the method of designing a box-type energy-dissipating section of a box-type energy-dissipating mudflow flume.

7 Claims, 1 Drawing Sheet

(56) References Cited

U.S. PATENT DOCUMENTS

| | | | | |
|---|---|---|---|---|
| 7,353,113 | B2 * | 4/2008 | Sprague | G06Q 10/06 702/2 |
| 2005/0091009 | A1 * | 4/2005 | Belcher | G06F 17/50 703/1 |

FOREIGN PATENT DOCUMENTS

| | | | |
|---|---|---|---|
| CN | 104831679 | A | 8/2015 |
| CN | 104848825 | A | 8/2015 |
| RU | 2 188 892 | C2 | 10/2000 |
| RU | 2006 115 861 | | 11/2007 |

* cited by examiner

METHOD OF DESIGNING BOX-TYPE ENERGY-DISSIPATING SECTION OF BOX-TYPE ENERGY-DISSIPATING MUDFLOW DIVERSION FLUME, AND APPLICATION

TECHNICAL FIELD

The invention relates to debris flow prevention and control technology, in particular, to a debris flow drainage channel with energy dissipation structures.

BACKGROUND

Drainage channels with energy dissipation structures are designed for drainage basins with large slopes. A drainage channel can be destroyed by strong abrasion and scour erosion in a gully with large slopes. In these cases, the channel cannot be used normally, and post-maintenance costs are high. Additionally, a drainage channel with energy dissipation structures can effectively control the velocity of debris flows and achieve safe discharge in the channel due to the increased roughness of the channel caused by the interactions between a debris flow and the stones used to fill the channel.

The rationale for selecting a roughness coefficient significantly affects the accuracy of debris flow velocity calculations; thus, the roughness coefficient is a key parameter in engineering studies. If the debris flow velocity is too large, then the debris flow may scour or even destroy the drainage channel. Conversely, if the debris flow velocity is too small, then debris flow deposition will occur in the drainage channel, which reduces the flow capacity. Therefore, the debris flow velocity in the drainage channel should be less than the erosion resistance velocity to ensure that the drainage channel does not experience erosion damage. For a drainage channel constructed with concrete or via other masonry methods, the roughness coefficient can be obtained according to the material type, and the debris flow velocity in the drainage channel can be calculated. However, the baseplate of a drainage channel with energy dissipation structures differs from that of a smooth drainage channel; thus, the roughness coefficient cannot be directly determined based on the material type, and the optimal design of this drainage channel is limited.

SUMMARY OF THE INVENTION

A general objective of the invention is to provide a method of designing an energy dissipation structure section and of preventing abrasion and erosion due to large debris flow velocities. This design method considers the following factors: the drainage channel slope, the length and width of the energy dissipation structure, and the diameter of the filled stones. In addition, this method can be used to calculate the roughness coefficient and optimally design an energy dissipation structure. Moreover, this method is simple and convenient, and it requires less parameters.

To achieve the above objective, the technical solution of the invention is as follows.

The invention provides a method of designing an energy dissipation structure section in a drainage channel. A drainage channel with energy dissipation structures includes a smooth channel, sidewalls, and an energy dissipation structure section. The energy dissipation structure section includes the transverse ground sill and the precast reinforced concrete energy dissipation box. The top surface of each section of the energy dissipation structure is open, and the remaining five sides are closed with stones. The height of the filled stones in the box is 0.5 to 0.8 times the height of the energy dissipation structure. The design method of the energy dissipation structure section is as follows.

Step 1: Determine the longitudinal slope J of the drainage channel through a field survey and large-scale topographic map measurements. Then, determine the construction material through a field survey and obtain the roughness coefficient $n_0$ of the smooth channel. Next, determine the admissible velocity (m/s) through field investigations based on the characteristics of the debris flow source, the particle gradation, and the construction materials.

Step 2: Set the length and width of the energy dissipation structure section and the mean diameter of the filled stones (unit: m) according to the designed debris flow discharge and the channel slope J determined in Step 1.

Step 3: Determine the roughness coefficient of the energy dissipation structure section using the following formula:

$$n = \left(0.0136 \cdot \frac{bL}{\pi D^2} \cdot J^{1/2} + 1.1921\right) \cdot n_0$$

where

- n—roughness coefficient of the energy dissipation structure section;
- $n_0$—roughness coefficient of the smooth channel determined in Step 1;
- b—width of the energy dissipation structure section (unit: m) determined in Step 2;
- L—length of the energy dissipation structure section (unit: m) determined in Step 2;
- D—mean diameter of the filled stones (unit: m) determined in Step 2;
- J—slope of the drainage channel determined in Step 1; and
- π—Pi (approximately equal to 3.14).

Step 4: Apply the parameters obtained in Steps 1 through 3 into the Manning formula. The debris flow velocity (unit: m/s) can be obtained as follows.

$$V = \frac{1}{n} R^{2/3} \cdot J^{1/2}$$

where V is the debris flow velocity (unit: m/s), n is the roughness coefficient of the energy dissipation structure section determined in Step 3, R is the hydraulic radius (unit: m), and J is the channel slope determined in Step 1.

Step 5: Compare the debris flow velocity calculated in Step 4 to the admissible velocity determined in Step 1. If the debris flow velocity obtained in Step 4 is not within the range of admissible velocities determined in Step 1, then reassign the values of the parameters and repeat Steps 2 to 5 until the debris flow velocity obtained in Step 4 is within the range of admissible velocities determined in Step 1. If the debris flow velocity obtained in Step 4 is within the range of admissible velocities determined in Step 1, then the design parameters of the energy dissipation structure section can be determined.

The application range of the design parameters is as follows: the width of the energy dissipation structure section is equal to 0.5~1.0 times the drainage channel width (b/B=0.5~1.0); the ratio of the length of the energy dissipation structure section to the total length of the drainage channel is 0.10~0.25; and the ratio of the upstream debris flow depth to the mean diameter of filled stones is 1.0~4.0. This method of designing the energy dissipation structure section is applicable to gullies with slopes from 15% to 35% and debris flow densities from 16 kN/m$^3$ to 22 kN/m$^3$.

In this design method, the key problem is the determination of the roughness coefficient of the energy dissipation structure section. The method of calculating the energy dissipation structure section was determined based on more than 160 groups of model tests. This calculation requires the drainage channel slope, length and width of the energy dissipation structure section, mean diameter of filled stones, and roughness coefficient of the smooth drainage channel. This design method can effectively regulate the debris flow velocity in the drainage channel by changing the length and width of the energy dissipation structure section and the average diameter of the packed stone.

Compared with prior methods, the invention considers the drainage channel slope, length and width of the energy dissipation structure section, mean diameter of filled stones, and roughness coefficient of the smooth drainage channel. Additionally, combined with the characteristics of the drainage channel with energy dissipation structures, the formula for calculating the comprehensive roughness coefficient of the energy dissipation structure section can be obtained by fitting a large number of model test results. Such an approach can reasonably determine roughness coefficients based on different design conditions and be used to produce the optimal design. Moreover, this design method is simple and effective.

BRIEF DESCRIPTION OF THE DRAWINGS

The features of the present invention, which is believed to be novel, are presented in detail in the appended claims. The organization and manner of operation of the invention, together with further objects and the associated advantages, may best be understood by referencing the following description and the accompanying drawings and figures:

Labels in the figures are as follows.

1 Baseplate of the smooth drainage channel
2 Ground sill
3 Energy dissipation structure
J Slope of the drainage channel
L Length of the energy dissipation structure section
b Width of the energy dissipation structure section
B Width of the drainage channel
h Debris flow depth

DETAILED DESCRIPTIONS OF THE ILLUSTRATED EMBODIMENTS

Embodiment 1

Figure 1:
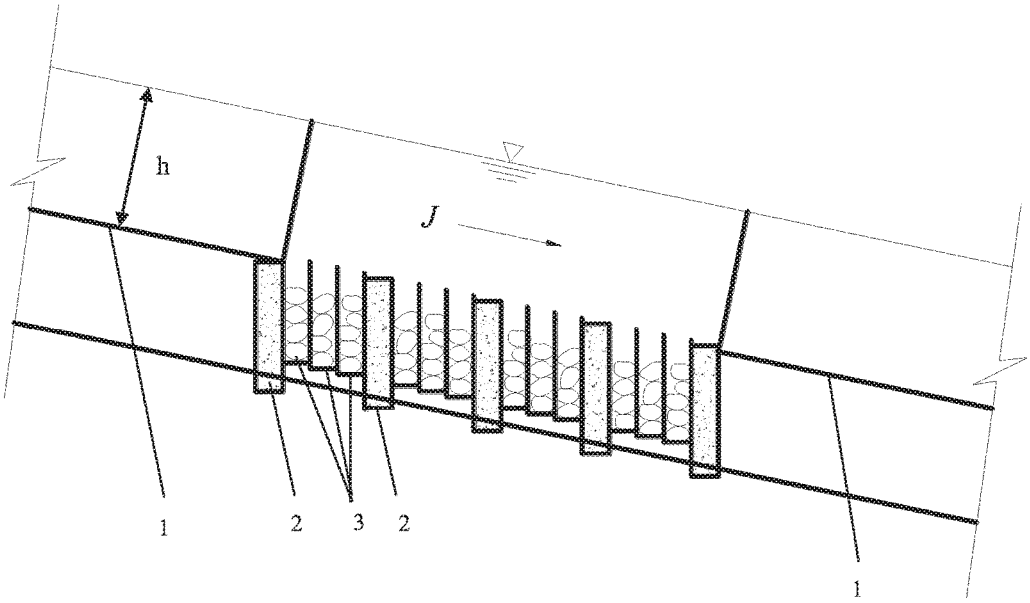
FIG. 1 is a section view of a drainage channel with an energy dissipation structure.
Figure 2:
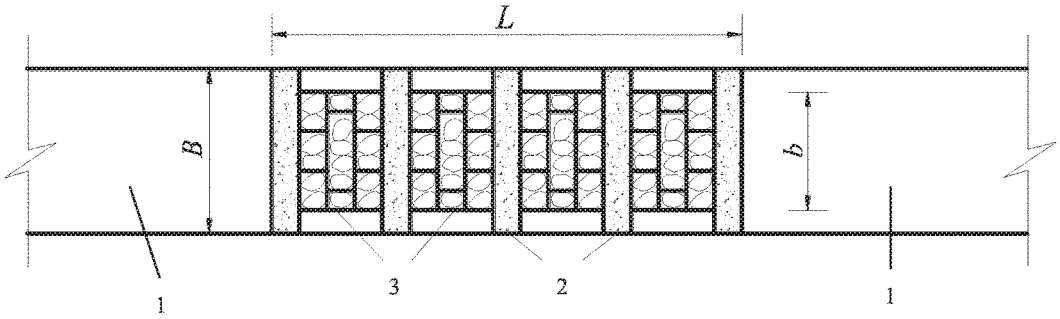
FIG. 2 is a perspective view of a drainage channel with an energy dissipation structure.

In this section, please refer to the drawings presented in FIGS. 1 and 2. A debris flow drainage basin is located at the left bank of the Mianyuan River, and the area of this drainage basin is 1.36 km$^2$. The main gully length is 2590 m. The elevation of the drainage basin ranges from 810 to 1987 m, representing a relative elevation difference of 1177 m. The area of slopes greater than or equal to 25° is approximately 1.16 km$^2$ in this drainage basin. Steep slopes with large longitudinal gradients are predominant in this drainage basin. This characteristic favors the concentration of precipitation processes and makes the basin prone to debris flow initiation. Before the devastating Wenchuan earthquake, no debris flow disaster had occurred in this gully in the past 100 years. However, the Wenchuan earthquake triggered numerous landslides and avalanches upstream of this drainage basin, and the total volume of transported material was approximately 80×10$^4$ m$^3$.

To protect local highways, infrastructure, lives and properties, debris flow hazard mitigation projects were conducted in the gully. A debris flow drainage channel is necessary for a debris flow to bypass a highway. A drainage channel includes a smooth channel, sidewalls, and an energy dissipation structure section. The energy dissipation structure is located between the two adjacent ground sills.

The method of designing the energy dissipation structure section is as follows based on the steps presented in the "Summary of the Invention" section.

Step 1: In this case, based on a field survey, it is determined that J=0.35, the debris flow density is 22 kN/m$^3$, the length of the drainage channel is 105 m, the width of the drainage channel is B=6.0 m and the height of the sidewall is 3.5 m. The construction material was determined through a field survey, and a roughness coefficient of $n_0$=0.02 was obtained for the smooth channel. Additionally, based on a field survey, it is determined that the permissible debris flow velocity must be smaller than 8 m/s and larger than 2.7 m/s to eliminate scour and deposition on the baseplate.

Step 2: The length and width of the energy dissipation structure section are b=3.0 m and L=15 m, respectively, and the mean diameter of the filled stones is D=0.4 m based on the designed debris flow discharge and the channel slope J=0.35 determined in Step 1.

Step 3: The roughness coefficient of the energy dissipation structure section was determined using the following formula:

$$n = \left(0.0136 \cdot \frac{bL}{\pi D^2} \cdot J^{1/2} + 1.1921\right) \cdot n_0 = \left(0.0136 \cdot \frac{3 \times 15}{3.14 \times 0.4^2} \cdot 0.35^{1/2} + 1.1921\right) \times 0.02 = 0.038$$

where n—roughness coefficient of the energy dissipation structure section;

$n_0$—roughness coefficient of the smooth channel determined in Step 1;

b—width of the energy dissipation structure section (unit: m) determined in Step 2;

L—length of the energy dissipation structure section (unit: m) determined in Step 2;

D—mean diameter of the filled stones (unit: m) determined in Step 2;

J—slope of the drainage channel determined in Step 1; and

π—Pi (approximately equal to 3.14).

Step 4: Applying the parameters obtained in Step 1 to 3 into the Manning formula, wherein h=4D=1.6 m. Thus, the debris flow velocity (unit: m/s) can be obtained as follows:

$$V = \frac{1}{n} R^{2/3} \cdot J^{1/2} =$$

-continued $$\frac{1}{n}\left(\frac{Bh}{B+2h}\right)^{2/3}\cdot J^{1/2}=\frac{1}{0.038}\left(\frac{6\times.6}{6+2\times1.6}\right)^{2/3}\times0.35^{1/2}=12.67\text{ m/s}$$

where V is the debris flow velocity (unit: m/s), n is the roughness coefficient of the energy dissipation structure section determined in Step 3, R is the hydraulic radius (unit: m), and J is the channel slope determined in Step 1.

Step 5: Comparing the debris flow velocity calculated in Step 4 with the admissible velocity determined in Step 1, the debris flow velocity obtained in Step 4 is not within the range of admissible velocities determined in Step 1 (12.67 m/s>8.0 m/s). Therefore, the values of the parameters are re-determined, and Steps 2 to 5 are repeated.

In the second calculation process, the length of the energy dissipation structure is L=20 m; the width of the energy dissipation structure is b=4 m; and the mean diameter of the filled stones is D=0.4 min. Additionally, the calculated roughness coefficient of the energy dissipation structure section is n=0.049, and the designed debris flow depth is h=4D=1.6 m. The calculated debris flow velocity is 10.12 m/s, which is larger than 8 m/s and is not within the range of admissible velocities determined in Step 1. Therefore, the values of the parameters are re-assigned, and Steps 2 to 5 are repeated.

In the third calculation process, the length of the energy dissipation structure is L=25 m; the width of the energy dissipation structure is b=6 m; and the mean diameter of the filled stones is D=0.3 m. Additionally, the calculated roughness coefficient of the energy dissipation structure section is n=0.109, and the designed debris flow depth is h=4D=1.2 m. The obtained debris flow velocity is 4.89 m/s, which is within the range of admissible velocities determined in Step 1. Therefore, the design parameters of the energy dissipation structure section can be established as L=25 m, b=6 m, and D=0.3 m.

Embodiment 2

In this section, please refer to the drawings presented in FIGS. 1 and 2. A debris flow drainage basin is located at the left bank of the Mianyuan River, and the area of this drainage basin is 7.81 $km^2$. The main gully length is 3250 m. The elevation of the drainage basin ranges from 883 to 2402 m, representing a relative elevation difference of 1519 m. After the Wenchuan earthquake, numerous large-scale debris flows were triggered by rainfall in this gully, and these flows are dangerous to local residents.

To protect local highways, infrastructure, lives and properties, debris flow hazard mitigation projects were conducted in the gully. A debris flow drainage channel is necessary for a debris flow to bypass a highway. A drainage channel includes a smooth channel, sidewalls, and an energy dissipation structure section. The energy dissipation structure is located between the two adjacent ground sills.

The method of designing the energy dissipation structure section is as follows based on the steps presented in the "Summary of the Invention" section.

Step 1: In this case, J=0.15, the debris flow density is 16 $kN/m^3$, the length of the drainage channel is 150 m, the width of the drainage channel is B=8.0 m and the height of the sidewall is 4 m. Based on the channel material, the roughness coefficient of the smooth channel is $n_0$=0.02, and the permissible debris flow velocity must smaller than 8 m/s and larger than 2.7 m/s to prevent scour and silt deposition on the baseplate.

Step 2: The length and width of the energy dissipation structure section are b=8.0 m and L=30 m, respectively. Additionally, the mean diameter of the filled stones is D=0.4 m based on the designed debris flow discharge and the channel slope J=0.15 in Step 1.

Step 3: The roughness coefficient of the energy dissipation structure section was determined using the following formula:

$$n=\left(0.0136\cdot\frac{bL}{\pi D^2}\cdot J^{1/2}+1.1921\right)\cdot n_0=\left(0.0136\cdot\frac{8\times30}{3.14\times0.4^2}\cdot0.15^{1/2}+1.1921\right)\times0.02=0.074$$

where

- n—roughness coefficient of the energy dissipation structure section;
- $n_0$—roughness coefficient of the smooth channel determined in Step 1;
- b—width of the energy dissipation structure section (unit: m) determined in Step 2;
- L—length of the energy dissipation structure section (unit: m) determined in Step 2;
- D—mean diameter of the filled stones (unit: m) determined in Step 2;
- J—slope of the drainage channel determined in Step 1; and
- π—Pi (approximately equal to 3.14).

Step 4: Applying the parameters obtained in Steps 1 through 3 into the Manning formula, h=1D=0.4 m. Thus, the debris flow velocity (unit: m/s) can be determined as follows:

$$V=\frac{1}{n}R^{2/3}\cdot J^{1/2}=\frac{1}{n}\left(\frac{Bh}{B+2h}\right)^{2/3}\cdot J^{1/2}=\frac{1}{0.074}\left(\frac{8\times0.4}{8+2\times0.4}\right)^{2/3}\times0.15^{1/2}=5.06\text{ m/s}$$

where V is the debris flow velocity (unit: m/s), n is the roughness coefficient of the energy dissipation structure section determined in Step 3, R is the hydraulic radius (unit: m), and J is the channel slope determined in Step 1.

Step 5: Comparing the debris flow velocity calculated in Step 4 to the admissible velocity determined in Step 1, the obtained debris flow velocity is within the range of admissible velocities determined in Step 1 (8.0 m/s>5.06 m/s>2.7 m/s); thus, the design parameters of the energy dissipation structure section can be established as L=30 m, b=8 m, and D=0.4 m.

We claim:

1. A method for designing an energy dissipation structure section of a drainage channel, wherein the drainage channel comprises a smooth channel, sidewalk, and the energy dissipation structure section;

wherein the energy dissipation structure section comprises a transverse ground sill and a precast reinforced concrete energy dissipation box;

wherein the energy dissipation structure section has a top surface that is open and the remaining five sides of the energy dissipation structure section are closed with stones; and wherein the height of filled stones in the box is 0.5 to 0.8 times the height of the energy dissipation structure section, the method comprising:

step 1: determine a channel slope J of the drainage channel through a field survey and topographic map measurements; determining a construction material through a field survey and obtain the roughness coefficient $n_0$ of the smooth channel; and determining a predetermined velocity through a field investigation;

step 2: setting a length and a width of the energy dissipation structure section and a mean diameter of the filled stones according to a designed debris flow discharge and the channel slope J determined in step 1;

step 3: determining the roughness coefficient n of the energy dissipation structure section using the following formula:

$$n = \left(0.0136 \cdot \frac{bL}{\pi D^2} \cdot J^{1/2} + 1.1921\right) \cdot n_0$$

where n—roughness coefficient of the energy dissipation structure section;

$n_0$—roughness coefficient of the smooth channel determined in step 1;

b—width of the energy dissipation structure section determined in step 2;

L—length of the energy dissipation structure section determined in step 2;

D—mean diameter of the filled stones determined in step 2;

J—slope of drainage channel determined in step 1; and

π—Pi;

step 4: applying the parameters obtained in steps 1 through 3 into a Manning formula, wherein the debris flow velocity is obtained as follows:

$$V = \frac{1}{n} R^{2/3} \cdot J^{1/2}$$

where V is the debris flow velocity, n is for the roughness coefficient of the energy dissipation structure section determined in step 3, R is the hydraulic radius, and J is the channel slope determined in step 1;

step 5: comparing the debris flow velocity calculated in step 4 with the predetermined velocity determined in step 1, wherein if the debris flow velocity obtained in step 4 is not equal to the predetermined velocity determined in step 1, reassigning the values of the parameters and repeat steps 2 to 5 until the debris flow velocity obtained in step 4 is equal to the predetermined velocity determined in step 1; and wherein if the debris flow velocity obtained in step 4 is equal to the predetermined velocity determined in step 1, setting the length and the width of the energy dissipation structure section and the mean diameter of the filled stones determined in step 2 as design parameters of the energy dissipation structure section.

2. The method according to claim 1, wherein the ratio of the width of the energy dissipation structure section to the width of the drainage channel ranges from 0.5 to 1.0.

3. The method according to claim 1, wherein the ratio of the length of the energy dissipation structure section to the length of the drainage channel ranges from 0.10 to 0.25.

4. The method according to claim 1, wherein the ratio of the height of the filled stones in the energy dissipation structure to the height of the energy dissipation structure ranges from 0.5 to 0.8.

5. The method according to claim 1, wherein the debris flow depth upstream of the energy dissipation structure is equal to 1.0-4.0 times the mean diameter of the filled stones.

6. The method according to claim 1, wherein the channel slope ranges from 0.15 to 0.35.

7. The method according to claim 1, wherein the debris flow de ranges from 16 $kN/m^3$ to 22 $kN/m^3$.

* * * * *